US010982572B2

(12) United States Patent
Knecht et al.

(10) Patent No.: US 10,982,572 B2
(45) Date of Patent: Apr. 20, 2021

(54) HYDRAULIC VALVE FOR CAM PHASER

(71) Applicant: ECO Holding 1 GmbH, Marktheidenfeld (DE)

(72) Inventors: Andreas Knecht, Tuebingen (DE); Gordon Neudoerfer, Maehringen (DE)

(73) Assignee: ECO Holding 1 GmbH, Marktheidenfeld (DE)

( * ) Notice: Subject to any disclaimer, the term of this patent is extended or adjusted under 35 U.S.C. 154(b) by 0 days.

(21) Appl. No.: 16/852,943

(22) Filed: Apr. 20, 2020

(65) Prior Publication Data

US 2020/0370449 A1 Nov. 26, 2020

(30) Foreign Application Priority Data

May 23, 2019 (DE) ..... 102019113713.6

(51) Int. Cl.
*F01L 1/344* (2006.01)

(52) U.S. Cl.
CPC ... *F01L 1/3442* (2013.01); *F01L 2001/34426* (2013.01)

(58) Field of Classification Search
CPC ..... F01L 1/3442; F01L 2001/34426; F01L 2001/3443; F01L 2001/34433; F01L 2301/00
See application file for complete search history.

(56) References Cited

U.S. PATENT DOCUMENTS 9,322,418 B2 * 4/2016 Knecht ..... F15B 15/12

FOREIGN PATENT DOCUMENTS

DE 102012106096 B3 5/2014

* cited by examiner

*Primary Examiner* — Zelalem Eshete
(74) *Attorney, Agent, or Firm* — Von Rohrscheidt Patents

(57) ABSTRACT

A hydraulic valve for a cam phaser, the hydraulic valve including a housing; a hollow cylindrical piston that is axially movable in a central opening of the housing that extends along a longitudinal axis of the housing and that includes shoulders; a supply connection configured to feed a hydraulic fluid; a first operating connection; a second operating connection; a tank connection, wherein one of the first operating connection and the second operating connection is connectable with the supply connection and another of the first operating connection and the second operating connection is connectable with the tank connection as a function of an axial position of the hollow cylindrical piston, wherein the hollow cylindrical piston includes a feed channel configured to connect with the supply connection and a drain channel configured to connect with the tank connection, wherein a divider wall is configured between the supply connection and the tank connection.

10 Claims, 1 Drawing Sheet

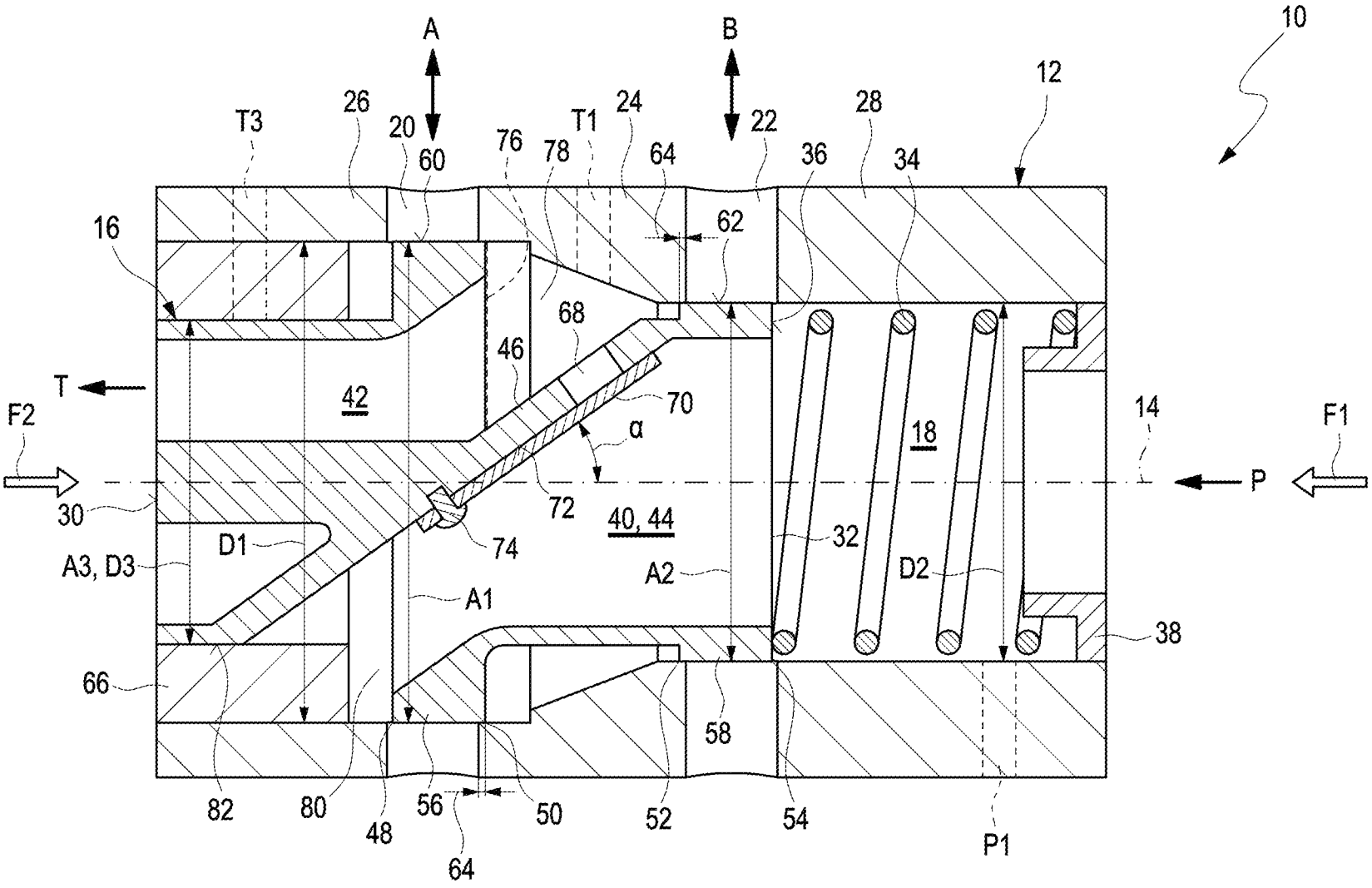
10
F1
P
14
38
12
P1
18
D2
34
28
32
36
54
22
B
62
58
64
70
A2
52
24
α
40, 44
T1
68
72
78
50
76
46
74
A1
64
A
60
56
20
48
26
42
80
T3
D1
82
16
T
30
A3, D3
66
F2

HYDRAULIC VALVE FOR CAM PHASER

RELATED APPLICATIONS

This application claims priority from and incorporates by reference German patent application DE 10 2019 113 713.6 filed on May 23, 2019 which is incorporated in its entirely by this reference.

FIELD OF THE INVENTION

The invention relates to a hydraulic valve for a cam phaser according to the preamble of patent claim 1.

BACKGROUND OF THE INVENTION

Hydraulic valves for cam phasers for internal combustion engines are well known in the art. The hydraulic valve includes a piston that is axially movable in a housing of the hydraulic valve and that controls a hydraulic loading of the cam phaser. Various configurations of hydraulic valves exist. The housing is formed hollow cylindrical. The piston is also configured hollow cylindrical. The cam phaser is controlled hydraulically by positioning the flowable piston and by opening or closing connections that are provided at the housing.

The patent document DE 10 2012 106 096 B3 discloses a hydraulic valve including a flowable piston including an inlet channel for connecting with a supply connection and a drain channel for connecting with a tank connection. The inlet channel and the drain channel are separated in the piston by a divider wall that is arranged at a slant angle relative to a longitudinal axis of the piston.

BRIEF SUMMARY OF THE INVENTION

Thus, it is an object of the invention to provide a hydraulic valve for a cam phaser that has a reduced reaction time.

The object is achieved according to the invention by A hydraulic valve for a cam phaser, the hydraulic valve including a housing; a hollow cylindrical piston that is axially movable in a central opening of the housing that extends along a longitudinal axis of the housing and that includes shoulders; a supply connection configured to feed a hydraulic fluid; a first operating connection; a second operating connection; a tank connection, wherein one of the first operating connection and the second operating connection is connectable with the supply connection and another of the first operating connection and the second operating connection is connectable with the tank connection as a function of an axial position of the hollow cylindrical piston, wherein the hollow cylindrical piston includes a feed channel configured to connect with the supply connection and a drain channel configured to connect with the tank connection, wherein a divider wall is configured between the supply connection and the tank connection, wherein the divider wall encloses an angle of less than 90° with the longitudinal axis, wherein the hollow cylindrical piston includes a first flow through opening configured to connect the first operating connection or the second operating connection with the drain channel and a second flow through opening configured to connect the feed channel with at least one of the first operating connection and the second operating connection, wherein the divider wall includes an overflow opening configured to provide a flow connection of the feed channel and the drain channel.

Advantageous embodiments with useful and non-trivial improvements are provided in the respective dependent claims.

The hydraulic valve according to the invention for a cam phaser includes a housing and a hollow cylindrical piston that is axially movable in a central opening of the housing that extends along a longitudinal axis of the housing and that includes shoulders. The hydraulic valve includes a supply connection that feeds hydraulic fluid, a first and a second operating connection and a tank connection wherein one of the operating connections is connectable with the supply connection and another operating connection is connectable with the tank drain connection according to a position of the piston. The piston includes a feed channel that is configured to connect with the supply channel and a drain channel that is configured to connect with the tank connection. A divider wall is arranged between the supply channel and the drain channel and encloses an angle of less than 90° with a longitudinal axis wherein the piston includes a first flow through opening configured to connect the operating connections with the drain channel and a second flow through opening configured to connect the supply channel with at least one of the operating connections. According to the invention the divider wall includes an overflow opening configured to provide a fluid connection of the supply channel and the drain channel.

The overflow opening is provided exclusively for flowing hydraulic fluid from a pressure reducing consumer into a pressure increasing consumer. It is another advantage of the flow through opening that hydraulic fluid from the pressure reducing consumer is not exclusively run into a tank drain of the hydraulic valve and used instead for accelerated pressure increase of the pressure increasing consumer. This facilitates a quicker filling of the pressure increasing consumer and thus reduces a reaction time of the cam phaser.

In one embodiment of the hydraulic valve according to the invention the overflow opening is openable or closable by a check valve. This advantageously facilitates controlling the overflow of hydraulic fluid from one channel into the other, wherein the control is provided as a function of the pressures supplied in the channels. This prevents uncontrolled overflow of hydraulic fluid through the overflow channel. In particular this hydraulic valve facilitates implementing a fast phasing function through a single check valve.

In order to prevent an overflow of hydraulic fluid from the supply channel into the drain channel in a simple manner the check valve is arranged at the wall surface of the divider wall that is oriented towards the supply channel. This means put differently that the check valve starts at the supply channel and covers the overflow opening. This facilitates arranging a check valve with a simple configuration, e.g. a disc configuration. As long as the check valve is configured disc shaped it can be produced in a cost effective manner. Furthermore arranging the check valve in the interior of the piston provides a piston with an exterior geometry that is producible inexpensively wherein the check valve prevents unintentional overflow of the hydraulic fluid.

In another advantageous embodiment the check valve is arranged at the divider wall by a fastener. The check valve can be integrated into the divider wall, however it can also be fixed inexpensively at a surface of the divider wall when the check valve is disc shaped or band shaped. Thus, the check valve can be attached at the divider wall in a simple manner using a fastener e.g. a rivet or a snap locking connection e.g. the check valve can be attached at one side so that the check valve can partially lift off from the divider wall and release the overflow opening as a function of a pressure in the drain channel that has to be greater than a pressure in the supply channel.

When the divider wall is configured insertable into the piston the check valve can be mounted in a simple and inexpensive manner. Advantageously the divider wall is bonded to an inner wall of the piston that is arranged opposite to the divider wall.

In another embodiment of the hydraulic valve according to the invention, the flow-through openings are configured at an enveloping surface of the piston. Thus, overlaps of the flow through openings with the connection openings can be implemented in a simple manner by axially displacing the piston to provide a flow through.

When the supply connection is arranged opposite to the feed channel additional shortening of the reaction time is obtainable since filling the feed channel and thus the pressure chambers that are to be filled with the hydraulic fluid can flow directly into the feed channel without deflection, this means without any significant flow loses.

In another embodiment of the hydraulic valve according to the invention, the second operating connection is supplyable with the hydraulic fluid through the supply connection immediately after the second operating connection is opened by the piston. This means that the piston has to have an axial extension that is at the most so that the connection opening that is associated with the second operating connection is covered so that the second operating connection is closed. Thus, a relatively short piston and accordingly a short hydraulic value which requires little installation space can be provided which advantageously also provides a lightweight hydraulic valve.

BRIEF DESCRIPTION OF THE DRAWINGS

Further advantageous embodiments and improvements can be derived from the subsequent detailed description of advantageous embodiments and form the subsequent drawing FIGURE. The features and feature combinations recited in the preceding description and the features and feature combinations that can be derived from the figures and the detailed description are not limited to the combinations shown or described but can also be used in other combinations or by themselves without departing from the spirit and scope of the invention. Like or functionally equivalent elements are provided with identical reference numerals. The drawing FIGURE illustrates a hydraulic valve for a cam phaser.

DETAILED DESCRIPTION OF THE INVENTION

A hydraulic valve 10 according to the invention for a cam phaser is configured according to the drawing FIGURE in an advantageous embodiment. The hydraulic valve 10 is configured as a central valve to be received in a rotor of the cam phaser that is not illustrated in detail. This means put differently that the hydraulic valve 10 is received in a central opening of the cam phaser and at least partially enveloped by the cam phaser.

The hydraulic valve 10 includes a housing 12 that is configured flowable. In order to hydraulically supply the cam phaser, plural connections A, B. P, T are provided at the housing 12. The housing 12 includes a piston 16 that is received axially movable along a longitudinal axis 14 of the hydraulic valve 10 in a central opening 18 of the housing 12. The housing 12 is configured substantially tubular.

The cam phaser facilitates adjusting opening and closing times of gas control valves of an internal combustion engine. Thus, the cam phaser adjusts an angular position of a cam shaft of the internal combustion engine relative to a crankshaft of the internal combustion engine continuously so that the cam shaft rotates relative to the crankshaft. Rotating the cam shaft adjusts opening and closing times of the gas control valves so that the internal combustion engine produces optimum power at a respective speed.

A stator of the cam phaser is connected torque proof with a drive wheel of the camshaft. Radially inward extending bars are configured in uniform intervals at insides of a stator base element so that an intermediary space is formed between two respective adjacent bars. A vane of a rotor hub of the rotor is arranged so that it protrudes into the intermediary space. The rotor hub includes a plurality of vanes corresponding to the plurality of intermediary spaces. Thus each intermediary space is dividable by the vanes into two pressure chambers. A pressure medium, typically hydraulic fluid, is introduced into the pressure chambers in a controlled manner by the hydraulic valve 10.

A pressure chamber is associated with each operating connection A, B. Thus a first pressure chamber is associated with the first operating connection A and a second pressure chamber is associated with the second operation connection B. In order to connect with the pressure chambers the first operating connection A includes a first connection opening 20, configured in the housing 12 and the second operating connection B includes a second connection opening 22, configured in the housing 12. In order to adjust an angular relationship between the cam shaft and the crankshaft the pressure medium in the first pressure chamber or in the second pressure chamber is pressurized while the second pressure chamber or the first pressure chamber is unloaded. The unloading is performed through the tank connection T so that hydraulic fluid can be drained through the tank connection T.

The hydraulic valve 10 according to the invention is illustrated in a longitudinal sectional view in the drawing FIGURE. The central opening 18 configured in the housing 12 includes two different inner diameters D1, D2 that transition into each other through a first conical housing portion 24. The first connection opening 20 is arranged in a second housing portion 26 in the housing 12 that includes the first inner diameter D1 that is greater than the second inner diameter D2 and is associated with the first operating connection A. The second connection opening 22 is arranged in a third housing portion 28 of the housing 12 that includes the second inner diameter D2 that is smaller than the first inner diameter D1 and is associated with the second operating connection B.

The piston 16 is arranged within the bushing shaped housing 12 axially moveable along the longitudinal axis 14 and the piston 16 is configured as a hollow piston. In order to move the piston 16 it includes a contact surface 30 for an electromagnetic actuator at a closing piston face. A plunger of the electromagnetic actuator contacts a center of the contract surface 30.

A reset element 34 configured as a compression coil spring contacts a piston end surface 36 of the piston 16 at an end 32 of the piston 16 wherein the end 32 is oriented away from the contact surface 30 and the piston end surface 36 is supported at a support element 38 of the housing 12. Thus the piston 16 is movable by the electromagnetic actuator against a spring force of the reset element 34 in the housing 12 in an axial direction.

The piston 16 includes a feed channel 40 and a drain channel 42. The feed channel 40 is configured as a cavity 44 within the piston 16 that is open opposite to the supply connection P. This means put differently that hydraulic fluid can flow from the supply connection P through the third housing section 28 into the feed channel 40.

The drain channel 42 is flow connected with the tank connection T. The separation of the feed channel 40 from the drain channel 42 is performed by a divider wall within the piston 16 wherein the divider wall essentially extends at a slant angle. This slanted extension divides four control edges 48, 50, 52, 54. The divider wall 56 is arranged at an angle $\alpha$ relative to the longitudinal axis 14 wherein the angle $\alpha$ has a value of 40°. The angle $\alpha$ can be configured according to reaction times and dimensions of the hydraulic valve 10.

The control edges 48, 50, 52, 54 are arranged at annular bars 56, 58 that extend radially from the piston 16. The first annular bar 56 that is positioned proximal to the contact surface 30 includes a first enveloping surface 60 with a first exterior diameter A1 and is supported in the central opening 18 in the portion of the first inner diameter D1. The second annular bar 58 that is distal from the contact surface 30 includes a second enveloping surface 62 with a second exterior diameter A2 which is smaller than the first exterior diameter A1 and is supported in the central opening 18 in the portion of the second interior diameter D2. The two control edges 50, 52, define the sides of the annular bars 56, 58 that are oriented towards each other. The two other control edges 48, 54 define the sides of the annular bars 56, 58 that are oriented away from each other.

The drain channel 42 leads from the two control edges 50, 52 that are oriented towards each other to the tank drain T. The feed channel 40, however, runs to the two control edges 48, 54 that are oriented away from each other. Thus, the two control edges 50, 52 that are oriented towards each other form drain edges, whereas the control edges 48, 54 that are oriented away from each other form feed edges.

In the blocking center position of the hydraulic valve 10 the two control edges 50, 52 that are oriented towards each other have a relatively large overlap 64 with the housing 12 as illustrated in the drawing FIGURE. However, the two control edges 48, 54 that are oriented away from each other have no overlap with the housing 12 in this blocking center position of the hydraulic valve 10. Thus, it is assured by the principle of drain edge control that the rotor is preloaded relative to the stator at a predetermined angular position. The principle of drain edge control is illustrated in more detail in DE 198 23 619 A1.

A third external diameter A3 of the piston 16 which is oriented towards the contact surface 30 is tolerance sealed and movable in the second housing portion 26 wherein a sleeve 66 is received in the second housing portion 26 and fixed at the housing 12. Thus, the sleeve 66 is pressed into the housing 12. The third exterior diameter A3 corresponds essentially to a third interior diameter D3 of the sleeve 66. The sleeve 66 is configured as a stop for the first annular bar 56.

The piston 16 is advantageously pressure balanced so that position control of the cam phaser is very precise. Thus axial forces impacting the piston 16 balance each other out. This means the force F1 that acts towards the left in the drawing FIGURE is balanced by the right acting force F2 that is an opposite force to the force F1.

In order to further improve a quick displacement of the piston 16 the divider wall 46 includes an overflow opening 68 so that hydraulic fluid can flow from the drain channel 42 into the feed channel 40 under particular pressure conditions in order to use cam torques described infra from the pressure chamber to be emptied to more quickly fill the pressure chamber that is to be filled.

In order to prevent an outflow of hydraulic fluid from the feed channel 40 into the drain channel 42 a check valve 70 is arranged at a wall surface 72 of the divider wall 46 that is oriented towards the feed channel 40.

In the instant embodiment the check valve 70 is configured as a flat sheet metal disc and attached by a rivet fastener 74 at the divider wall 46. Put differently the check valve 70 is configured disc shaped. The attachment element 74 can also be configured differently, e.g. as a bolt or as a snap locking connection or the check valve 70 is attached at the divider wall 46 by a snap locking connection.

When the hydraulic loading of the pressure chambers changes which causes a relative rotation of the rotor the piston 16 is moved axially which either opens the first operating connection A opposite to the drain channel 42 in order to drain hydraulic fluid depending on the starting position, wherein a first flow through opening 78 of the piston 16 that is associated with the drain channel 42 is opened or the second operating connection B is opened opposite to the drain channel 42 in order to drain the hydraulic fluid, wherein the first flow through opening 78 is positioned at least partially opposite to the second connection opening 22, and wherein a second flow through opening 80 of the piston 16 that is associated with the feed channel 40 is arranged opposite to the first connection opening 20. The flow through openings 78, 80 are arranged at an enveloping surface 82 of the piston 16 which also includes the first enveloping surface 60 and the second enveloping surface 62.

The check valve 70 is opened as function of the instant pressure conditions so that the pressure chamber to be filled can be filled additionally with the hydraulic fluid through the overflow opening 68 from the pressure chamber to be emptied and thus quicker than for a closed check valve 70. This means put differently that a reaction time for filling the respective pressure chamber is substantially reduced.

The piston 16 has an axial length which facilitates opening the second operating connection B by the piston 16 in order to directly supply the second operating connection B through the supply connection P. By the same token the piston 16 can have an increased axial length and can have additional openings for filling the second operating connection B.

In order to adapt the hydraulic valve 10 to the internal combustion engine that includes the cam phaser a variable throttle on the functional side of the tank connection T is proposed. Thus draining the hydraulic fluid into the tank connection T and thus a pressure in the drain channel 42 can be adjusted.

In order to facilitate assembly the divider wall 46 is configured as an inserted component.

In the drawing FIGURE two additional alternative connection options are drawn in dashed lines. Thus, the drain to the tank can be configured as a tank connection T1 instead of being configured as the tank connection T. Thus, the tank connection T1 is arranged axially between the two operating connections A, B. In this case the drain channel 42 can also be closed corresponding to the dashed line 76.

Alternatively it is also possible to arrange the axial connections radially by providing a recess in the housing 12 or in the piston 16. This is illustrated based on the alternative supply connection P1 or the alternative tank connection T3.

In one alternative embodiment the sleeve 66 is not implemented. Instead another configuration can be provided that facilitates assembly. For example the housing 12 can be configured as a two piece housing that is bolted together and that includes the stop instead of the sleeve 66. The bolting plane then facilitates assembly of the hydraulic valve 10.

According to this embodiment the hydraulic valve 10 can be configured as a central hydraulic valve that is also designated as central valve. However the hydraulic valve can also be configured as a non-central hydraulic valve. The hydraulic valve can also be configured as a cartridge hydraulic valve.

It is appreciated that designating the two operating connections with the letters A or B is arbitrary and can also be reversed. The piston 16 can be fabricated from metal or synthetic material. The synthetic material is produced by injection molding. When using the synthetic material fiber reinforcement is advantageous as described in the patent document DE 10 2007 026 831 B3.

When cam torques are applied in the first pressure chamber associated with the first operating connection A, the feed channel 40 is fillable with the hydraulic fluid starting from the first operating connection A through the first connection opening 20 and a first flow through opening 78 that is flow connected with the drain channel 42 through the overflow opening 68 from the first operating connection A. Through the feed channel 40 and the second connection opening 22 that is open in this position of the piston 16 hydraulic fluid that flows through the overflow opening 68 into the feed channel 40 is supplied to the second operating connection B.

When cam torques are applied to the pressure chamber that is associated with the second operating connection B the feed channel 40 is fillable with the hydraulic fluid from the second operating connection B through the second connection opening 22 and a second flow through opening 80 that is flow connected with the feed channel 40 through the overflow opening 68 from the second operating connection B. Thus, hydraulic fluid is supplied to the first operating connection A through the feed channel 40 and the first connection opening that is open in this position of the piston 16 wherein the hydraulic fluid flows through the overflow opening 68 into the feed channel 40.

What is claimed is:

1. A hydraulic valve for a cam phaser, the hydraulic valve comprising:

a housing;

a hollow cylindrical piston that is axially movable in a central opening of the housing that extends along a longitudinal axis of the housing and that includes shoulders;

a supply connection configured to feed a hydraulic fluid;

a first operating connection;

a second operating connection;

a tank connection, wherein one of the first operating connection and the second operating connection is connectable with the supply connection and another of the first operating connection and the second operating connection is connectable with the tank connection as a function of an axial position of the hollow cylindrical piston, wherein the hollow cylindrical piston includes a feed channel configured to connect with the supply connection and a drain channel configured to connect with the tank connection, wherein a divider wall is configured between the supply connection and the tank connection, wherein the divider wall encloses an angle of less than 90° with the longitudinal axis, wherein the hollow cylindrical piston includes a first flow through opening configured to connect the first operating connection or the second operating connection with the drain channel and a second flow through opening configured to connect the feed channel with at least one of the first operating connection and the second operating connection, wherein the divider wall includes an overflow opening configured to provide a flow connection of the feed channel and the drain channel.

2. The hydraulic valve according to claim 1, wherein the overflow opening is openable and closable by a check valve.

3. The hydraulic valve according to claim 2, wherein the check valve is arranged at a wall surface of the divider wall that is oriented towards the feed channel.

4. The hydraulic valve according to claim 2, wherein the check valve is configured disk shaped.

5. The hydraulic valve according to claim 2, wherein the check valve is arranged at the divider wall by a fastener.

6. The check valve according to claim 5, wherein the fastener is a rivet or a clip closure.

7. The hydraulic valve according to claim 1, wherein the divider wall is insertable into the piston.

8. The hydraulic valve according to claim 1, wherein the first flow through opening and the second flow through opening are configured at an enveloping surface of the piston.

9. The hydraulic valve according to claim 1, wherein the supply connection is arranged opposite to the feed channel.

10. The hydraulic valve according to claim 1, wherein the second operating connection is supplyable with the hydraulic fluid directly through the supply connection when the second operating connection is opened by the hollow cylindrical piston.

* * * * *